United States Patent [19]

Lestina

[11] 4,443,536

[45] Apr. 17, 1984

[54] NONDIFFUSIBLE PHOTOGRAPHIC COUPLERS AND PHOTOGRAPHIC ELEMENTS AND PROCESSES EMPLOYING SAME

[75] Inventor: Gregory J. Lestina, Rochester, N.Y.

[73] Assignee: Eastman Kodak Company, Rochester, N.Y.

[21] Appl. No.: 366,885

[22] Filed: Apr. 8, 1982

Related U.S. Application Data

[63] Continuation-in-part of Ser. No. 296,086, Aug. 26, 1981, abandoned.

[51] Int. Cl.[3] ..... G03C 7/26

[52] U.S. Cl. ..... 430/552; 430/553; 430/554; 430/555; 430/556; 430/557; 430/558

[58] Field of Search ..... 430/552, 553, 554, 555, 430/556, 557, 558

[56] References Cited

U.S. PATENT DOCUMENTS

| | | | |
|---|---|---|---|
| B 311,317 | 1/1975 | Coraluppi et al. . | |
| 3,189,616 | 6/1965 | Loffler et al. . | |
| 3,623,871 | 11/1971 | van Poucke et al. . | |
| 3,973,979 | 8/1976 | Meier et al. . | |
| 4,032,346 | 6/1977 | Furutachi et al. . | |
| 4,076,533 | 2/1978 | Ota et al. . | |
| 4,254,212 | 3/1981 | Yagihara et al. | 430/552 |
| 4,296,200 | 10/1981 | Yagihara et al. | 430/558 |
| 4,334,011 | 6/1982 | Aohi et al. | 430/552 |

FOREIGN PATENT DOCUMENTS

| | | |
|---|---|---|
| 909318 | 8/1960 | United Kingdom . |
| 1044959 | 10/1966 | United Kingdom . |
| 1210878 | 11/1970 | United Kingdom . |
| 1407922 | 10/1975 | United Kingdom . |
| 1070626 | 6/1977 | United Kingdom . |
| 1494777 | 12/1977 | United Kingdom . |
| 1552196 | 9/1979 | United Kingdom . |
| 2037751 | 7/1980 | United Kingdom . |
| 2052773 | 1/1981 | United Kingdom . |
| 2066811 | 7/1981 | United Kingdom . |

OTHER PUBLICATIONS

Research Disclosure, May 1977, Item No. 15737.

*Primary Examiner*—J. Travis Brown
*Attorney, Agent, or Firm*—Richard E. Knapp

[57] ABSTRACT

Photographic couplers comprising a coupler moiety and a ballast moiety have advantageous properties when the ballast moiety is terminated with a hydroxyphenylsulfonyl or hydroxyphenylsulfinyl group. The couplers are useful in photographic emulsions and element.

13 Claims, No Drawings

NONDIFFUSIBLE PHOTOGRAPHIC COUPLERS AND PHOTOGRAPHIC ELEMENTS AND PROCESSES EMPLOYING SAME

This application is a continuation-in-part of U.S. application Ser. No. 296,086 filed Aug. 26, 1981, now abandoned.

This invention relates to nondiffusible photographic couplers and to silver halide photographic elements employing such couplers. In a particular aspect it relates to couplers containing a novel ballast group.

Images are commonly obtained in the photographic art by a coupling reaction between the development product of a silver halide developing agent (i.e., oxidized aromatic primary amino developing agent) and a color forming compound commonly referred to as a coupler. The dyes produced by coupling are indoaniline, azomethine, indamine or indophenol dyes, depending upon the chemical composition of the coupler and the developing agent. The subtractive process of color formation is ordinarily employed in multicolor photographic elements and the resulting image dyes are usually cyan, magenta and yellow dyes which are formed in or adjacent silver halide layers sensitive to radiation complementary to the radiation absorbed by the image dye; i.e., silver halide emulsions sensitive to red, green and blue radiation.

Since this is a mature art, the patent and technical literature is replete with references to compounds which can be used as couplers for the formation of photographic images. Preferred couplers which form cyan dyes upon reaction with oxidized color developing agents are phenols and naphthols. Representative couplers are described in the following patents and publications: U.S. Pat. Nos. 2,772,162, 2,895,826, 3,002,836, 3,034,892, 2,474,293, 2,423,730, 2,367,531, 3,041,236 and "Farbkuppler-ein Literaturubersicht," published in Agfa Mitteilungen, Band II, pp. 156–175 (1961).

Preferred couplers which form magenta dyes upon reaction with oxidized color developing agent are pyrazolones, pyrazolotriazoles, pyrazolobenzimidazoles and indazolones. Representative couplers are described in such patents and publications as U.S. Pat. Nos. 2,600,788, 2,369,489, 2,343,703, 2,311,082, 2,673,801, 3,152,896, 3,519,429, 3,061,432, 3,062,653, 3,725,067, 2,908,573 and "Farbkuppler-eine Literaturubersicht," published in Agfa Mitteilungen, Band II, pp. 126–156 (1961).

Couplers which form yellow dyes upon reaction with oxidized color developing agent are acylacetanilines such as benzoylacetanilides and pivalylacetanilides. Representative couplers are described in the following patents and publications: U.S. Pat. Nos. 2,875,057, 2,407,210, 3,265,506, 2,298,443, 3,048,194, 3,447,928 and "Farbkuppler-eine Literaturubersicht," published in Agfa Mitteilungen, Band II, pp. 112–126 (1961).

Also known are couplers which from black or neutral dyes upon reaction with oxidized color developing agent. Representative such couplers are resorcinols and m-aminophenols such as are described in U.S. Pat. Nos. 1,939,231, 2,181,944, 2,333,106, 4,126,461, German OLS No. 2,644,194 and German OLS No. 2,650,764.

Also known are compounds which react with oxidized color developing agent in the same way as couplers but which do not yield a dye. Such compounds are employed to modify the photographic image by competing with dye-forming coupler for oxidized color developing agent or by releasing a photographic reagent, such as a development inhibitor, as a result of the coupling reaction. While many such compounds are not commonly referred to as couplers, it is convenient to consider them as such in view of the similarities in the ways they and couplers react during photographic processing. For the purposes of the present invention, they are considered couplers. Representative such couplers are described in such patents and published patents applications as U.S. Pat. Nos. 3,632,345, 3,928,041, 3,938,996, 3,958,993, 3,961,959, 4,010,035, 4,029,503, 4,046,574, 4,049,455, 4,052,213, 4,063,950, 4,075,021, 4,121,934, 4,157,916, 4,171,223, 4,186,012 and 4,187,110; U.K. Patent Specification Nos. 1,445,797, 1,504,094, 1,536,341 and 2,032,914A; German Published Patent Application (DT-OS) Nos. 2,448,063, 2,552,505, 2,610,546 and 2,617,310; and Belgian Pat. No. 839,083.

When intended for incorporation in photographic elements, couplers are commonly dispersed therein with the aid of a high boiling organic solvent, referred to as a coupler solvent. Couplers are rendered nondiffusible in photographic elements, and compatible with coupler solvents, by including in the coupler molecule a group referred to as a ballast group. This group is located on the coupler in a position other than the coupling position and imparts to the coupler sufficient bulk to render the coupler nondiffusible in the element as coated and during processing. It will be appreciated that the size and nature of the ballast group will depend upon the bulk of the unballasted coupler and the presence of other substituents on the coupler.

Although numerous couplers are known in the art, there is a continuing search for novel couplers which improve, or optimize for particular applications, such properties of the coupler as stability, reactivity, and general compatibility with other components in the element, and such properties of the resultant dye as efficient light absorption, stability and hue.

I have found a novel class of nondiffusible couplers which contain a ballast group which confers upon couplers good reactivity and which confers upon dyes derived from such couplers good light absorption properties and desirable hues.

Couplers of this invention comprise a coupler moiety and a ballast moiety, the ballast moiety being terminated with a hydroxyphenylsulfonyl group or a hydroxyphenylsulfinyl group.

Thus, in one aspect this invention relates to novel photographic couplers, as described above.

In another aspect this invention relates to photographic silver halide emulsions and elements containing couplers as described above.

In yet another aspect this invention relates to processes of forming photographic images employing photographic elements containing couplers as described above.

In still another aspect this invention relates to processed photographic images comprising dyes derived from couplers as described above.

The coupler moiety may be any coupler moiety known or used in the art to form a colored or colorless reaction product with oxidized color developing agent. Representative couplers have been noted above. The ballast can be any ballast, or portion thereof, which, in accordance with this invention, is terminated with a hydroxyphenylenesulfonyl or hydroxyphenylenesulfinyl group.

Preferred couplers have the structural formula:

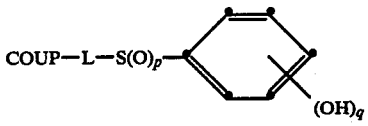

I where:

COUP represents a coupler moiety;

p is 1 or 2;

q is 1 to 3; and

L is a direct linkage (i.e., a covalent bond) or a bivalent linking group.

The coupler moiety represented by COUP can be any coupler moiety used in photographic elements. The remainder of the molecule shown in formula I can be joined to the coupler moiety at any position, other than the coupling position, where ballast groups commonly are joined. The coupling position of the coupler moiety can be unsubstituted, or substituted with a coupling off group which can modify the equivalency of the coupler, its reactivity, its dispersability or which, upon release from the coupler, interacts with other components of the element. The coupler moiety can include substituents in other positions.

The bivalent linking group represented by L can be any of the groups found in ballast groups, such as alkylene of 1 to 10 carbon atoms, arylene of 6 to 10 carbon atoms, heterocyclene of 5 to 10 carbon atoms, oxygen, sulfur, amino, amido, sulfonamido, carbamoyl, sulfamoyl, and combinations of such linking groups, e.g., alkarylene, aralkylene, aminoarylene, aminoalkylene, amidoarylene, amidoalkylene, ureido, alkarylamido, amidoarylsulfamoyl, aminoarylamido, aminoarylsulfamoylalkyl and the like.

Preferred couplers have the structural formula:

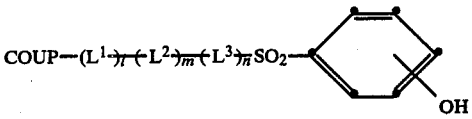

II where:

COUP is as defined above;

l, m and n are each individually 0 or 1;

$L^1$ represents a bivalent group selected from

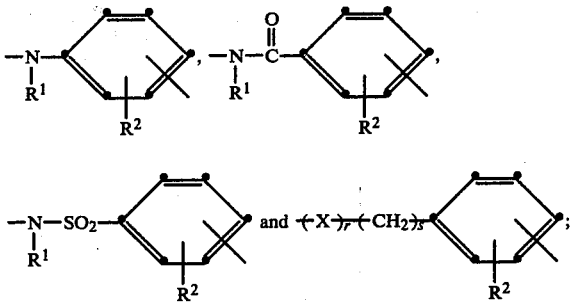

$L^2$ represents a bivalent group selected from

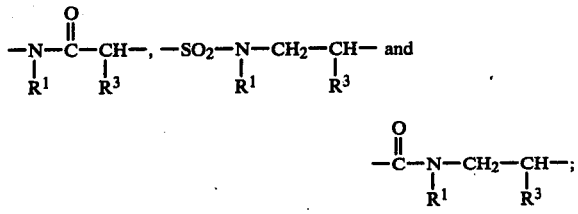

$L^3$ represents a bivalent group selected from

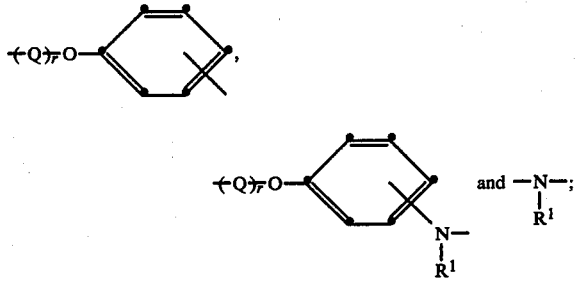

$R^1$ and $R^3$ are each individually hydrogen, alkyl of 1 to 20 carbon atoms or aryl of 6 to 20 carbon atoms;

$R^2$ is hydrogen or one or more halogen, alkyl or alkoxy substituents;

X is —O— or —S—;

Q is $-\overset{O}{\overset{\|}{C}}-$ or $SO_2$;

r is 0 or 1; and s is 0 to 10.

Particularly preferred couplers have the structural formula:

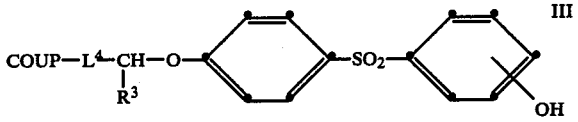

III where:

$L^4$ represents a bivalent group selected from

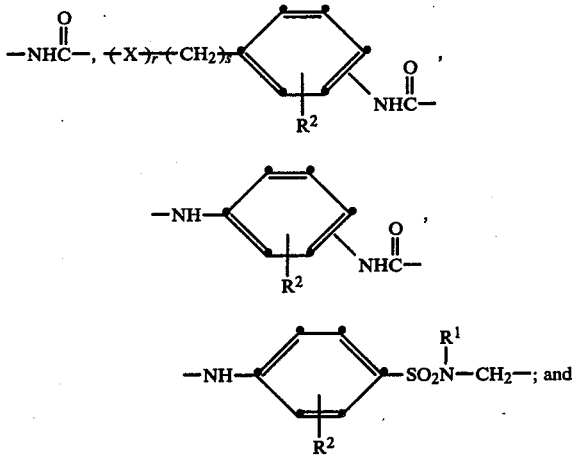

COUP, $R^1$, $R^2$, $R^3$, r and s are as defined above.

In an especially preferred embodiment, the hydroxy group in structural formulae II and III is in the para position.

In the above structural formulae the alkyl, alkylene, aryl, arylene and heterocyclene groups can be unsubstituted or substituted with one or more groups such as halogen, nitro, amino, carboxy, alkyl, alkoxy, aryl, aryloxy, heterocyclyl, carbamoyl, amido, sulfamoyl, sulfonamido and the like.

As indicated above, common yellow dye-forming couplers are acylacetanilides such as pivalylacetanilides and benzoylacetanilides. Common magenta dye-forming couplers are pyrazolones, pyrazolotriazoles, pyrazolobenzimidazoles and indazolones. Common cyan dye-forming couplers are phenols and naphthols, common neutral dye-forming couplers are resorcinols and m-aminophenols. Common non-dye-forming couplers are acyclic and cyclic compounds in which the active position, corresponding to the coupling position, is adjacent to or in conjugation with a carbonyl group or an imino group, such as α- or γ-substituted ketones or imines, e.g. cyclopentanones, cyclohexanones, indanones, indanoimines, oxyindoles and oxazolinones. These couplers can form the coupler moiety, COUP in the above formulae. Structures of representative coupler moieties are shown below. In these structures Z represents hydrogen or a coupling-off group and the unsatisfied bond, or bonds, indicates the preferred position, or positions, at which there can be attached the remainder of the molecule shown in the above structures; it being recognized that the coupler moiety can contain other substituents.

Cyan dye-forming coupler moieties:

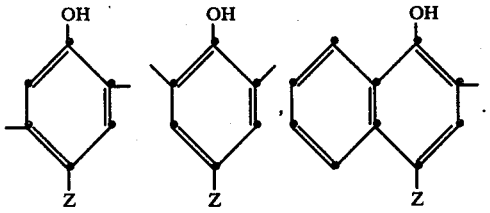

Magenta dye-forming coupler moieties:

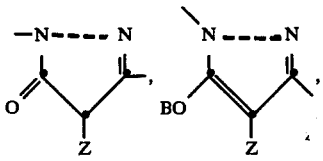

(B represents a blocking group capable of being removed during processing, e.g., by alkaline cleavage or coupling)

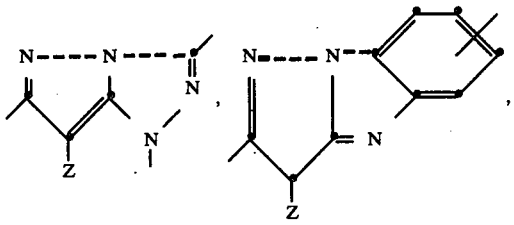

-continued

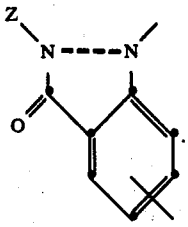

Yellow dye-forming coupler moieties:

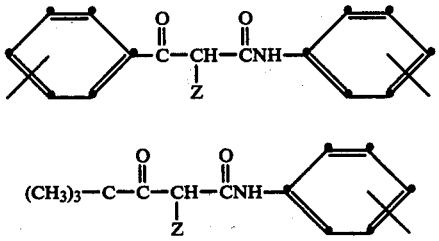

Non-dye-forming coupler moieties:

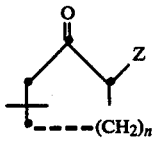

n = 1,2,

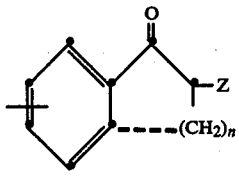

n = 1,2,

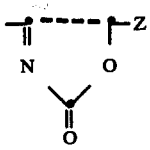

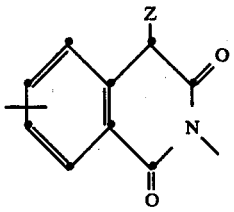

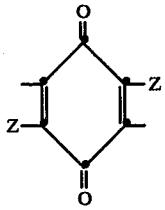

Neutral dye-forming coupler moieties:

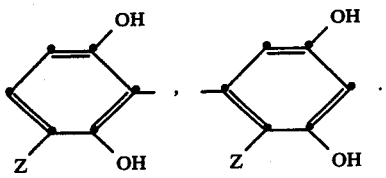

Specific couplers of the invention, which are shown below, contain ballast moieties of general structures $B^1$ through $B^6$, where Y is —OH.

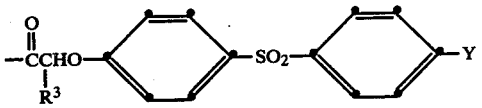

$B^1$: $R^3 = C_4H_9$—n
$B^2$: $R^3 = C_{10}H_{21}$—n
$B^3$: $R^3 = C_{12}H_{25}$—n

-continued

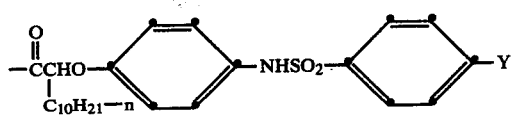

$B^4$

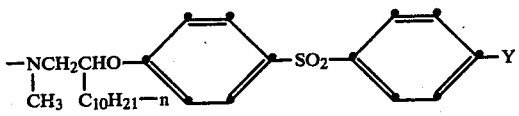

$B^5$

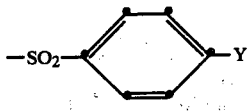

$B^6$

Cyan dye-forming couplers of this invention include the following:

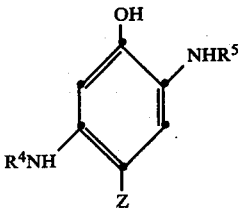

| Coupler No. | $R^4$ | $R^5$ | Z |
|---|---|---|---|
| C-1 | n-$C_3H_7CO$— | —$B^3$ | —H |
| C-2 | $B^3$— | —$COC_3H_7$—n | —H |
| C-3 | $B^3$— | —$COCF_3$ | —H |
| C-4 | $B^3$— | —$COC_3F_7$—n | —H |
| C-5 | $B^2$— | 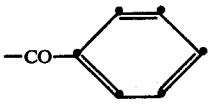 | —Cl |
| C-6 | $B^4$— | 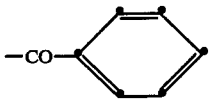 | —Cl |
| C-7 | $B^2$— | 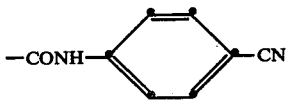 | —H |
| C-8 | $B^4$— | 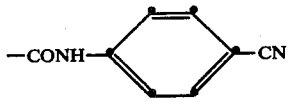 | —H |
| C-9 | $B^2$— | 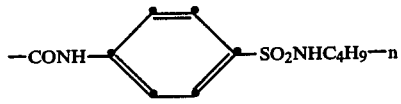 | —H |

-continued
Cyan dye-forming couplers of this invention include the following:
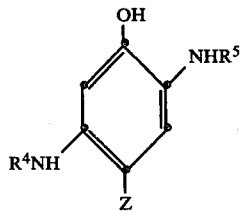
| Coupler No. | $R^4$ | $R^5$ | Z |
|---|---|---|---|
| C-10 | $B^2$— | 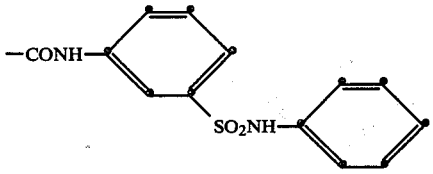  | —H |
| C-11 | $B^2$— | 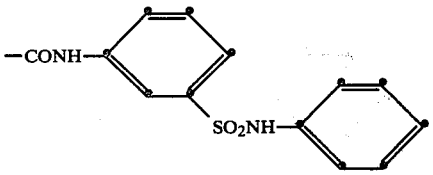  | $—OC_6H_5$ |
| C-12 | $B^2$— | 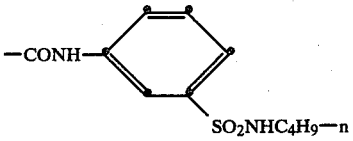  | —H |
| C-13 | $B^2$— | 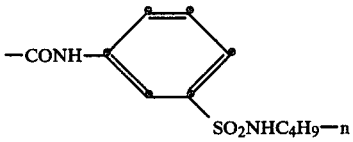  | $—OCH_3$ |
| C-14 | $B^2$— | 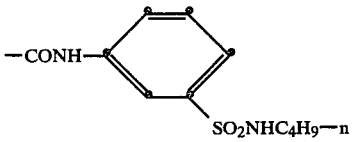  | $—OC_6H_5$ |
| C-15 | $B^2$— | 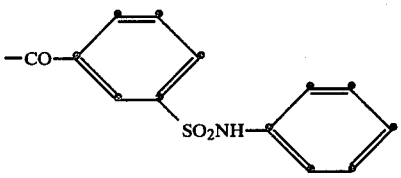  | —Cl |
| C-16 | $B^2$— | 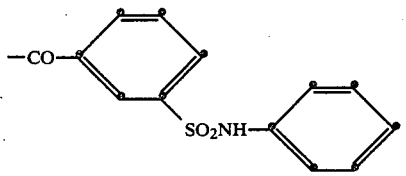  | $—OC_6H_5$ |

-continued
Cyan dye-forming couplers of this invention include the following:
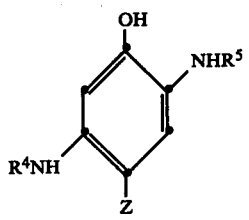
| Coupler No. | $R^4$ | $R^5$ | Z |
|---|---|---|---|
| C-17 | $B^2$— | 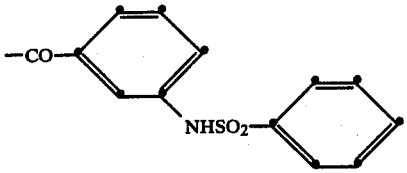 | —Cl |
| C-18 | $B^2$— | 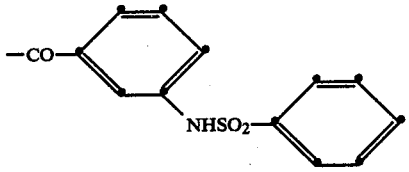 | $—OC_6H_5$ |
| C-19 | $B^4$— | 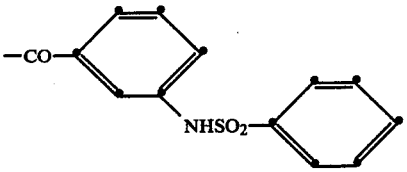 | $—OC_6H_5$ |
| C-20 | $B^2$— | 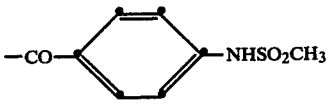 | $—OC_6H_5$ |
| C-21 | $B^2$— | 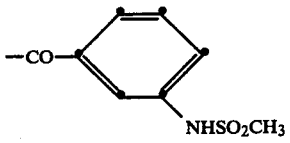 | $—OC_6H_5$ |
| C-22 | $B^2$— | 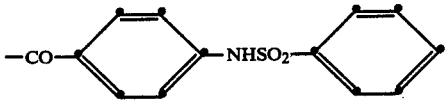 | $—OC_6H_5$ |
| C-23 | $B^2$— | 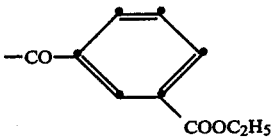 | $—OC_6H_5$ |
| C-24 | $B^2$— | 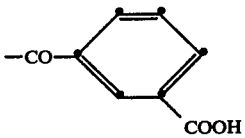 | 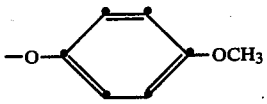 |

-continued
Cyan dye-forming couplers of this invention include the following:
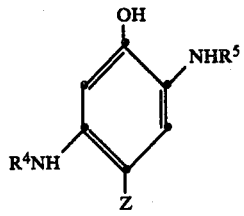
| Coupler No. | $R^4$ | $R^5$ | Z |
|---|---|---|---|
| C-25 | $B^2$— | 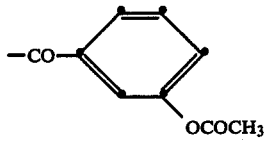 | —$OC_6H_5$ |
| C-26 | $B^2$— | 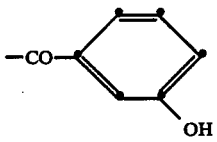 | 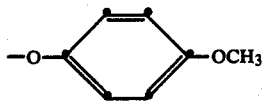 |
| C-27 | $B^2$— | 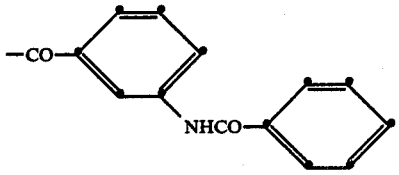 | —$OC_6H_5$ |
| C-28 | $B^2$— | 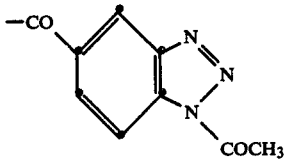 | —$OC_6H_5$ |
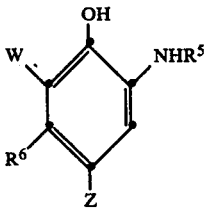
| Coupler No. | $R^6$ | $R^5$ | W | Z |
|---|---|---|---|---|
| 29 | $CH_3$— | —$B^3$ | —H | —H |
| 30 | $CH_3$— | —$B^2$ | —H | —H |
-continued
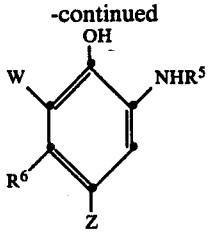
| Coupler No. | $R^6$ | $R^5$ | W | Z |
|---|---|---|---|---|
| 31 | $C_2H_5$— | —$B^2$ | —Cl | —Cl |
Magenta dye-forming couplers of this invention include the following:
| Coupler No. | Z |
|---|---|
| M-1 | —H |

-continued
Magenta dye-forming couplers of this invention include the following:
| Coupler No. | | Z |
|---|---|---|
| M-2 | 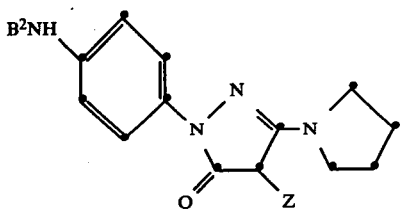 | 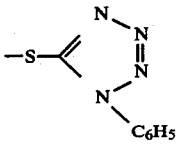 |
| M-3 | 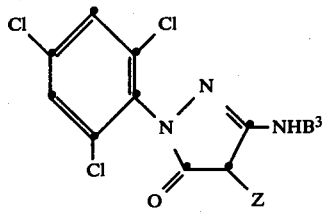 | —H |
| M-4 | 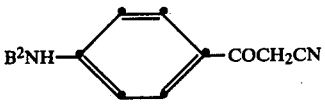 | |
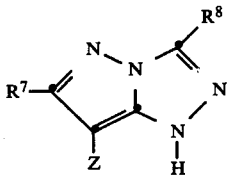
| Coupler No. | $R^7$ | $R^8$ | Z |
|---|---|---|---|
| M-5 | $CH_3$— | —$(CH_2)_2$— 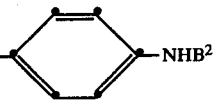 —$NHB^2$ | —Cl |
| M-6 | $CH_3$— | —$(CH_2)_2$— 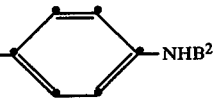 —$NHB^2$ | —$OC_6H_5$ |
| M-7 | $CH_3$— | —$SCH_2CH_2$— 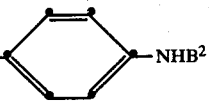 —$NHB^2$ | —Cl |
| M-8 | $CH_3$— | —$(CH_2)_3$— 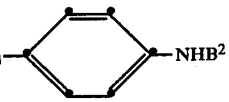 —$NHB^2$ | —H |
| M-9 | $CH_3$— | " | —Cl |
| M-10 | $CH_3$— | " | —$SC_7H_{15}$—n |
| M-11 | $CH_3$— | " | 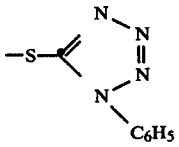 |
| M-12 | $CH_3OCH_2$— | " | —Cl |

-continued
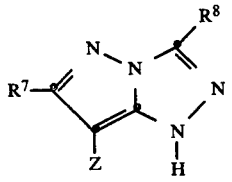
| Coupler No. | $R^7$ | $R^8$ | Z |
|---|---|---|---|
| M-13 | $CH_3$— | " | —$OC_6H_5$ |
| M-14 | $CH_3$— | " | —$SCH_2CH_2N(CH_3)_2$ |
| M-15 | $CH_3$— | " | 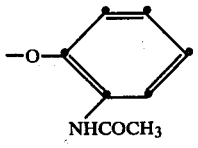 |
| M-16 | $CH_3$— | " | 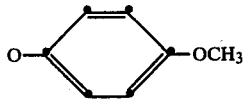 |
| M-17 | $CH_3$— | " | 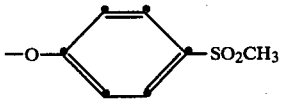 |
| M-18 | $CH_3$— | " | 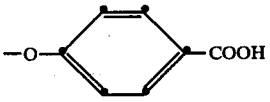 |
| M-19 | $CH_3$— | " | 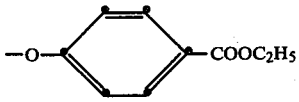 |
| M-20 | $CH_3$— | " | 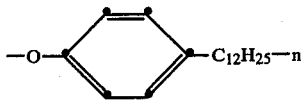 |
| M-21 | $CH_3$— | 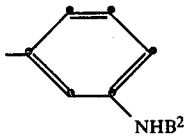 | —H |
| M-22 | $CH_3$— | 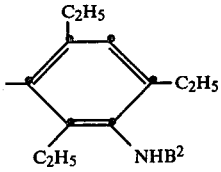 | 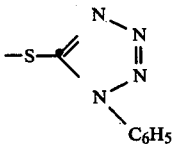 |
| M-23 | $CH_3$— | " | —H |
| M-24 | $CH_3$— | " | —Cl |

-continued
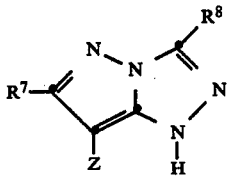
| Coupler No. | $R^7$ | $R^8$ | Z |
|---|---|---|---|
| M-25 | $CH_3$— | 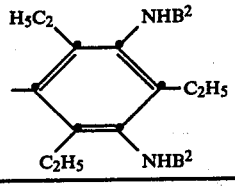 | —Cl |
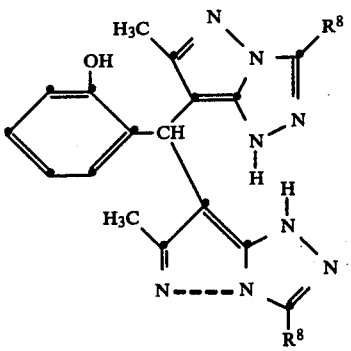
M-26
-continued
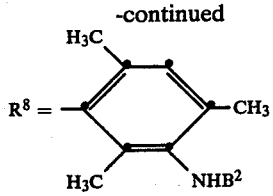
| Coupler No. | $R^9$ | $R^{10}$ | $R^{11}$ | Z |
|---|---|---|---|---|
| M-27 | Cl— | —H | —$NHB^3$ | —H |
| M-28 | Cl— | —H | —$NHB^2$ | —H |
| M-29 | Cl— | —H | —$NHB^2$ | —$SC_7H_{15}$—n |
| M-30 | Cl— | —H | —$NHB^2$ | —$SC_6H_5$ |
| M-31 | Cl— | —H | —$NHB^2$ | 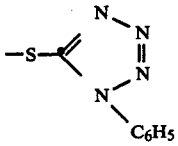 |
| M-32 | $(CH_3)_2NSO_2$— | —$SO_2B^5$ | —H | —H |
| M-33 | $B^2NH$— | —Cl | —H | —H |
| M-34 | $B^2NH$— | —$SO_2NHCH_3$ | —H | —H |
| M-35 | $B^2NH$— | —$SO_2N(CH_3)_2$ | —H | —H |
| M-36 | $B^4NH$— | —$SO_2N(CH_3)_2$ | —H | —H |
| M-37 | $B^2ONH$— or $B^2N(OH)$— | —$SO_2N(CH_3)_2$ | —H | —H |

M-38
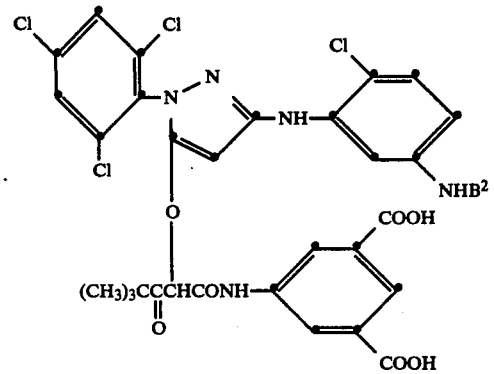
-continued
M-39
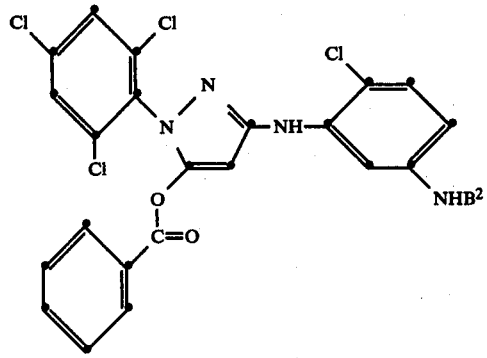
Yellow dye-forming couplers of this invention include the following:
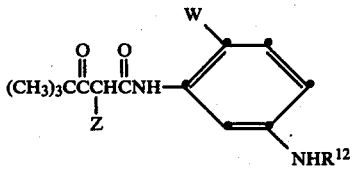
| Coupler No. | W | $R^{12}$ | Z |
|---|---|---|---|
| Y-1 | Cl— | $-B^6$ | 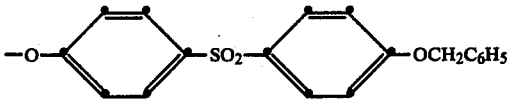 |
| Y-2 | Cl— | $-B^1$ | 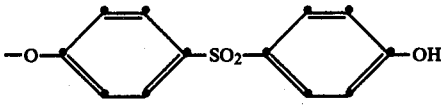 |
| Y-3 | H— | $-B^1$ | 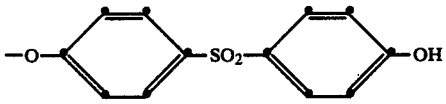 |
| Y-4 | Cl— | $-B^2$ | 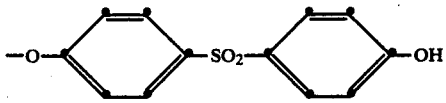 |
| Y-5 | Cl— | $-B^2$ | —H |
| Y-6 | $CH_3O$— | $-B^2$ | 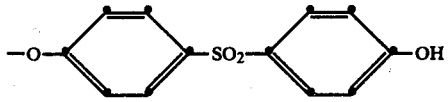 |
| Y-7 | Cl— | $-B^2$ | 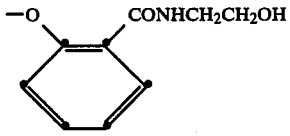 |
| Y-8 | $CH_3O$— | $-B^2$ | 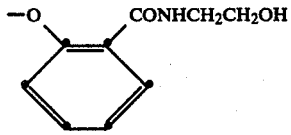 |

Noncolor forming couplers of this invention include the following:

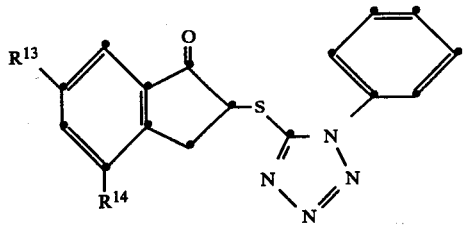

| Coupler No. | $R^{13}$ | $R^{14}$ |
|---|---|---|
| U-1 | $B^2NH$— | H— |
| U-2 | H— | $B^2NH$— |

Couplers of this invention can be prepared by attaching a blocked hydroxyphenylsulfonyl or blocked hydroxyphenylsulfinyl group directly to the coupler moiety or by attaching such a group to the remainder of the ballast group after which the ballast group is attached to the coupler moiety. Thereafter the blocking group is removed. Conventional condensation reactions can be employed in joining the various moieties which ultimately form the coupler. For many of the couplers of this invention it is convenient to provide the hydroxyphenylsulfonyl group using a 4,4'-sulfonyldiphenol mono ether (e.g. benzyl ether) or mono ester (e.g. acetyl ester). Conventional reaction techniques techniques can be employed to attach such a compound to the remainder of the ballast group and the thus formed ballast group to the coupler moiety. Thereafter, the blocking group can be removed by hydrogenation (in the case of the ether) or alkaline hydrolysis (in the case of an ester.) When the coupler, or the remainder of the ballast group, has an amino group available for reaction, it is convenient to react that amino group with a blocked hydroxybenzenesulfonyl chloride after which the blocking group is removed.

The couplers of this invention can be used in the ways and for the purposes that couplers are used in the photographic art.

Typically, the couplers are incorporated in silver halide emulsions and the emulsions coated on a support to form a photographic element. Alternatively, the couplers can be incorporated in photographic elements adjacent the silver halide emulsion where, during development, the coupler will be in reactive association with development products such as oxidized color developing agent. Thus, as used herein, the term "associated therewith" signifies that the coupler is in the silver halide emulsion layer or in an adjacent location where, during processing, it will come into reactive association with silver halide development products.

The photographic elements can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806, issued Dec. 7, 1982.

A typical multicolor photographic element would comprise a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler, at least one of the couplers in the element being a coupler of this invention. The element can contain additional layers, such as filter layers, interlayers, overcoat layers, subbing layers, and the like.

In the following discussion of suitable materials for use in the emulsions and elements of this invention, reference will be made to *Research Disclosure,* December 1978, Item 17643, published by Industrial Opportunities Ltd., Homewell Havant, Hampshire, P09 1EF, U.K., the disclosures of which are incorporated herein by reference. This publication will be identified hereafter by the term "Research Disclosure".

The silver halide emulsions employed in the elements of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

In addition to the couplers of this invention, the elements of the invention can include additional couplers as described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof, can contain brighteners (see Research Disclosure Section V), antifoggants and stabilizers (see Research Disclosure Section VI), antistain agents and image dye stabilizer (see Research Disclosure Section VII, paragraphs I and J), light absorbing and scattering materials (see Research Disclosure Section VIII), hardeners (see Research Disclosure Section XI), plasticizers and lubricants (see Research Disclosure Section XII), antistatic agents (see Research Disclosure Section XIII), matting agents (see Research Disclosure Section XVI) and development modifiers (see Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylene diamines. Especially preferred are 4-amino-N,N-diethyl-aniline hydrochloride, 4-amino-3-methyl-N,N-diethylaniline hydrochloride, 4-amino-3-methyl-N-ethyl-N-β-(methanesulfonamido) ethylaniline sulfate hydrate, 4-amino-3-methyl-N-ethyl-N-β-hydroxyethylaniline sulfate, 4-amino-3-β-(methanesulfonamido)ethyl-N,N-diethyl-aniline hydrochloride and 4-amino-N-ethyl-N-(2-methoxy ethyl)-m-toluidine di-p-toluene sulfonic acid.

With negative working silver halide this processing step leads to a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The following examples are included for a further understanding of this invention.

PREPARATIVE EXAMPLE 1

Preparation of Ballast Group Intermediate $B^2Cl$, where Y=OBz (benzyl ether)

To a solution of 90 g (0.31 mol) methyl 2-bromododecanoate and 104.4 g (0.31 mol) 4,4'-sulfonyldiphenol monobenzyl ether in 0.35 L dry acetone were added 1 g sodium iodide and 214.2 g (1.55 mol) potassium carbonate. After refluxing the mixture 20 h, solids were removed by filtration and the filtrate concentrated to a waxy solid. Recrystallization from methanol gave a white solid ($B^2OCH_3$, Y=OBz), mp 73°-75° C., with the correct elemental analysis and expected NMR spectrum. A solution of 120 g (0.21 mol) of this product in 0.8 L dimethylformamide was added with stirring to 0.5 L of 2.3 M aqueous potassium hydroxide solution, water was added and the cloudy solution stirred 0.5 h before pouring into acidic ice-water. The resulting solid was collected, dissolved in dichloromethane, and the solution washed, dried over magnesium sulfate, and concentrated. Recrystallization from acetonitrile yielded 67 g white solid ($B^2OH$, Y=OBz), mp 119°-121° C., with the expected NMR spectrum and elemental analysis. This acid was converted to the acid chloride by dissolving 67 g (0.12 mol) in 0.4 L thionyl chloride and stirring 5 h. Excess thionyl chloride was removed under vacuum and the product recrystallized from dry acetonitrile to give a white solid ($B^2Cl$, Y=OBz), mp 84°-85° C., with the expected NMR spectrum and elemental analysis.

PREPARATIVE EXAMPLE 2

Preparation of Ballast Group Intermediate $B^2Cl$, where Y=OAc (acetyl ester)

A solution of 455 g (0.82 mol), $B^2OCH_3$, Y=OBz in 1.6 L tetrahydrofuran and 0.4 L acetic acid was hydrogenated 12 h at 50 psi and 50° C. over 45 g 5% palladium on charcoal catalyst. The catalyst was removed by filtration and the concentrated filtrate drowned in water. An ethyl acetate solution of resulting white solid was washed, dried, concentrated, and the product recrystallized from acetonitrile to give 340 g (0.74 mol) white solid ($B^2OCH_3$, Y=OH), mp 63°-65° C. with the expected elemental analysis. Hydrolysis of this ester was accomplished by slowly adding an aqueous solution containing 40 g (1 mol) sodium hydroxide to a stirred solution of the ester in 1 L dimethylformamide, stirring 2 h then pouring into acidified ice-water. The resulting gummy solid dissolved in ethyl acetate was washed with dilute hydrochloric acid, dried, and concentrated. Recrystallization from acetonitrile yielded a white solid ($B^2OH$, Y=OH), mp 116°-117° C. This phenolic acid was acetylated by dissolving in 70 mL acetic anhydride and 7 mL concentrated surfuric acid, stirring 30 minutes at room temperature, then on a steam bath for 30 minutes, cooling, and pouring into 8 L water. The product was recrystallized from methanol to give a white solid ($B^2OH$, Y=OAc), mp 73°-75° C. Refluxing 35 g (0.07 mol) of this acid in excess thionyl chloride for 5 h and concentrating yielded a colorless oil, which on trituration, in ligroin gave 22 g white solid ($B^2Cl$, Y=OAc), mp 66°-69° C.

PREPARATIVE EXAMPLE 3

Preparation of Ballast Group Intermediate $B^3Cl$, where Y=OBz

The procedural steps were similar to those for preparation of $B^2Cl$ in Example 1, except that ethyl 2-bromotetradecanoate was the starting material. Intermediates included white solids $B^3OCH_2CH_3$, Y=OBz (mp 55°-61° C.); $B^3OH$, Y=OBz (mp 117°-118° C.); and $B^3Cl$, Y=OBz (mp 81°-84° C.).

PREPARATIVE EXAMPLE 4

Preparation of Ballast Group Intermediate $B^1Cl$ where Y=OBz

The procedural steps were similar to those for preparation of $B^2Cl$ in Example 1, except that ethyl 2-bromobutyrate was the starting material. Intermediates included white solids $B^1OCH_2CH_3$, Y=OBz (mp 102°-105° C.); $B^1OH$, Y=OBz (mp 147.5°-148.5° C.); and $B^1Cl$, Y=OBz (mp 40° C.).

PREPARATIVE EXAMPLE 5

Preparation of Ballast Intermediate $B^4Cl$ where Y=OBz

A solution of 10.2 g (0.029 mol) methyl 2-p-nitrophenoxy)dodecanoate in 100 mL tetrahydrofuran was shaken 6 h under 40 psi hydrogen in the presence of 0.7 g 10% palladium on charcoal catalyst to reduce the nitro group. Then 6.3 mL (0.04 mol) N,N-dimethylaniline and 8.2 g (0.029 mol) p-benzyloxybenzenesulfonyl chloride were added and the mixture stirred overnight at room temperature. The catalyst was removed by filtration and the filtrate poured into cold dilute hydrochloric acid. Ethyl acetate extraction, washing, drying, concentration, and purification through silica gel yielded 14 g colorless oil ($B^4OCH_3$, Y=OBz). This was dissolved in 60 mL tetrahydrofuran and 40 mL methanol, stirred 0.5 h with 20 mL aqueous sodium hydroxide solution and poured into cold dilute hydrochloric acid. Ethyl acetate extraction, washing, drying, concentration, ligroin trituration yielded 12 g white crystals ($B^4OH$, Y=OBz), mp 100°-101° C., with the correct elemental analysis. To a stirred solution of 10 g (0.018 mol) of this acid in 50 mL tetrahydrofuran was added 1.8 mL (0.022 mol) oxalyl chloride and 5 drops dimethyl formamide. After 1.5 h concentration gave 0.018 mol of brown oil $B^4Cl$, Y=OBz.

PREPARATIVE EXAMPLE 6

Preparation of Ballast Intermediate $B^5H.HCl$ where Y=OH

To a solution of 24 g (0.043 mol) acid chloride $B^2Cl$ in 400 mL tetrahydrofuran was added a 40% aqueous solution containing 10 g (0.125 mol) methylamine. After 0.5 h stirring, the mixture was poured over acidified ice-water, extracted with diethyl ether, and the organic layer washed, dried, and concentrated to yield, after further purification on a 50:50 silica gel/Fluorisil® column, a clear colorless oil ($B^2NHCH_3$, Y=OBz). Reduction was accomplished by refluxing 16 g (0.029 mol) of this amide product and 16 mL 2 M borane-methyl sulfide complex in 400 mL tetrahydrofuran for 3 h. The cooled reaction mixture was slowly acidified with 50% hydrochloric acid solution, then extracted with diethyl ether. Acidification and concentration of the washed and dried organic layer gave 14 g of white solid ($B^5H.HCl$, Y=OH).

Final steps in the synthesis of couplers of this invention generally involved the attachment of the ballast group and the removal of the ballast blocking group, if any. For example, in Scheme I an amino-substituted coupler moiety, COUP-$NH_2$, is allowed to react with an acid chloride ballast group and the resulting intermediate is converted to the desired coupler by hydrogenation to remove the benzyl group.

SCHEME I

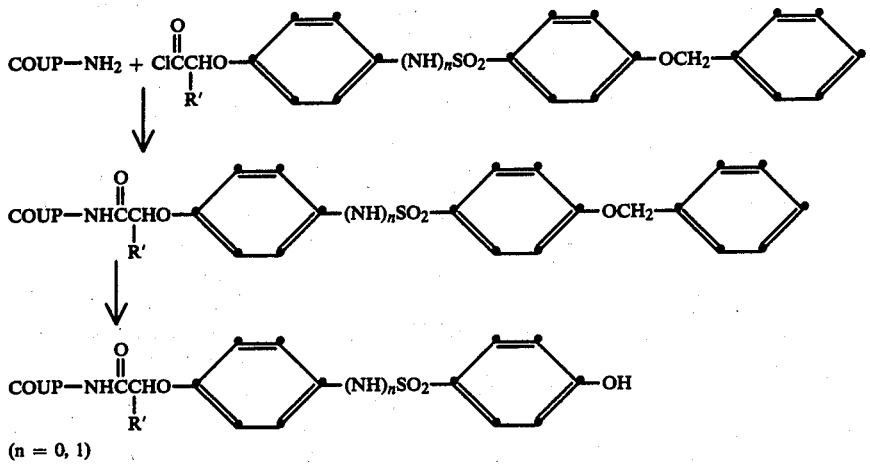

Where the blocking group is acetyl, as in Scheme II, it is removed by alkaline hydrolysis:

SCHEME II

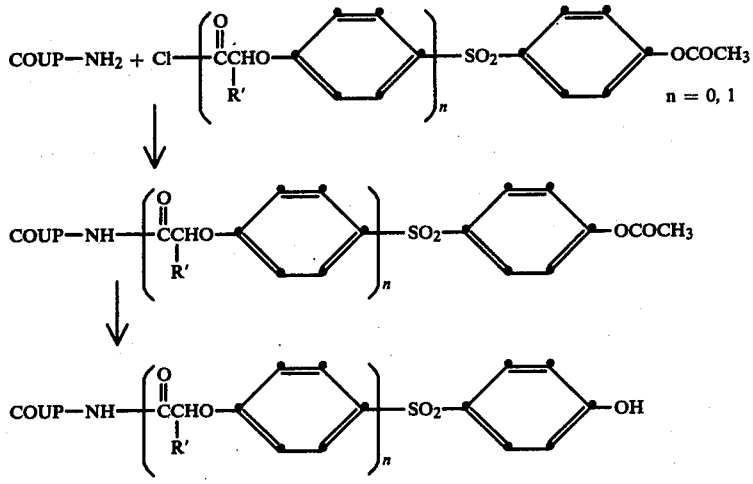

Alternatively, if the coupler is substituted with an acidic function, a ballast group containing an amine function may be attached according to Scheme III.

SCHEME III

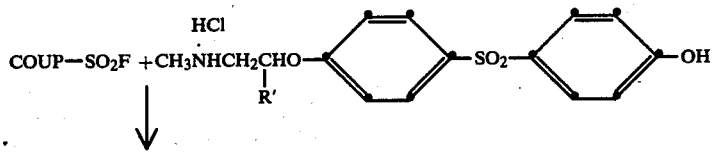

-continued

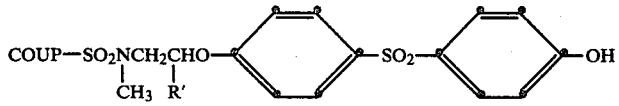

PREPARATIVE EXAMPLE 7

Preparation of Coupler C-8 by Scheme I

A suspension of 5.4 g (0.018 mol) 2-(p-cyanophenylureido)-5-nitrophenol in 200 ml tetrahydrofuran was shaken overnight under 40 psi hydrogen with 1.6 10% palladium on charcoat catalyst and 0.3 mL acetic acid. Then 0.018 mol of the acid chloride $B^4Cl$ prepared in Example 5 and 6.8 mL dimethylaniline were added under nitrogen and the mixture stirred 0.5 h before removing the catalyst by filtration and pouring the filtrate into cold dilute hydrochloric acid. Ethyl acetate extraction, washing, drying, concentration, and crystallization from acetonitrile yielded 10.2 g of the pale white solid benzyl ether of the desired coupler. A solution of this product in 100 ml tetrahydrofuran was shaken overnight under 40 psi hydrogen with 2.5 g 10% palladium on charcoat catalyst and 0.5 ml acetic acid. The catalyst was removed by filtration and the reduction product concentrated and crystallized from acetonitrile to give 6.1 g white solid coupler C-8, mp 103°-106° C., with an intrared spectrum and elemental analysis consistent with the desired structure.

PREPARATIVE EXAMPLE 8

Preparation of Coupler M-28 by Scheme II

A solution of 50 g (0.115 mol) 3-(2-chloro-5-nitroanilino)-1-(2,4,6-trichlorophenyl)-2-pyrazolin-5-one in dimethylformamide and tetrahydrofuran was reduced with 35 psi hydrogen and Raney nickel catalyst. Removal of the catalyst by filtration and concentration of the filtrate gave 21 g (0.052 mol) light yellow solid 3-(2-chloro-5-aminoanilino-1-(2,4,6-trichlorophenyl)-2-pyrazolin-5-one. To an acetic acid solution containing 6.9 g (0.017 mol) of this amine and 9.5 g potassium acetate was added, in small portions, 9.5 g (0.019 mol) of the acid chloride $B^2Cl$ prepared in Example 2. After stirring overnight, the mixture was concentrated to a third of its volume, poured into a large volume of water and extracted with diethyl ether. The organic layers were washed, dried, concentrated, and crystallized from methanol to give 14 g (0.016 mol) buff-colored solid acetate ester of the desired coupler, mp 115°-116° C. To a solution of this product in dimethylformamide stirred under nitrogen was added an aqueous solution containing 2 g potassium hydroxide. After 15 minutes the mixture was acidified with hydrochloric acid, poured into dilute hydrochloric acid, extracted with diethyl ether, washed, dried, concentrated, and crystallized from methanol to give 9.2 g white crystalline coupler M-28, mp 127°-130° C.

PREPARATIVE EXAMPLE 9

Preparation of Coupler M-8 by Scheme I

A suspension of 10 g (0.035 mol) 6-methyl-3-[3-(p-nitrophenyl)-propyl]-1H-pyrazolo[3,2-c]-5-triazole in 300 mL tetrahydrofuran was shaken about 2 h at 25° C. with 35 psi hydrogen and a palladium on charcoal catalyst. Removal of the catalyst, concentration of the filtrate, and recrystallization from acetonitrile gave a buff-colored solid amine, mp 194°-6° C. To a stirred acetic solution of 7.6 g (0.03 mol) of this amine product and 2 g potassium acetate was added, in small portions, 16.7 g (0.03 mol) of the acid chloride $B^2Cl$ prepared in Example 1. After stirring overnight, the mixture was poured into a large volume of water, extracted with diethyl ether, and the combined extracts then washed, dried, and concentrated to give the white solid benzyl ether of the desired coupler, mp 122°-124° C. A concentrated solution of 7 g (0.009 mol) of the product in tetrahydrofuran was shaken 2 h under 40 psi hydrogen with a mixture of palladium on charcoal catalyst in ethanol. Removal of the catalyst by filtration, concentration, and recrystallization from acetonitrile gave 5.5 g cream-colored solid coupler M-8, mp 170°-172° C., with an infrared spectrum and elemental analysis consistent with the desired compound.

PREPARATIVE EXAMPLE 10

Preparation of Coupler M-32 by Scheme II

A mixture of 8 g (0.015 mol) 3-(2-chloro-4-fluorosulfonylanilino)-1-(2,6-dichloro-4-dimethyl-sulfamoyl phenyl)-2-pyrazolin-5-one and 5.5 g aluminum chloride in 175 mL 1,2-dichloroethane was refluxed 15 minutes. After cooling to room temperature, 7.25 g (0.015 mol) of the amine salt $B^4H.HCl$ prepared in Example 6 in 25 mL pyridine was added and the mixture refluxed 2 h. Then a mixture of hydrochloric acid, ice, and diethyl ether was added and the organic layer washed, dried, concentrated, and triturated with hexane to give 14.2 g light tan solid coupler M-32 with the correct elemental analysis.

PREPARATIVE EXAMPLE 11

Preparation of Coupler Y-1 by Scheme II

To a solution of 30.3 g (0.05 mol) α-pivalyl-α-[4-(p-benzyloxyphenylsulfonyl)phenoxy]-2-chloro-5-aminoacetanilide in 150 mL pyridine was added 11.8 g (0.05 mol) p-acetoxybenzenesulfonyl chloride at room temperature. After stirring overnight, the mixture was poured onto 1 L of ice-water containing 50 mL concentrated hydrochloric acid. The resulting solid was collected, dissolved in 250 mL ethanol and treated with an alcoholic solution of potassium hydroxide. After stirring 1 h the mixture was poured over acidified ice-water. The collected solid was then dissolved in boiling benzene and cyclohexane added to give a precipitate. Recrystallization from ethanol-cyclohexane yielded 23 g coupler Y-1, mp 174°-175° C., with the correct elemental analysis.

PREPARATIVE EXAMPLE 12

Preparation of Coupler Y-2 by Scheme I

To a solution of 57.8 g (0.095 mol) α-pivalyl-α-[4-(p-benzyloxyphenylsulfonyl)-phenoxy]-2-chloro-5-amino acetanilide and 13 g quinoline, cooled to 0° C., was added in one portion 45 g (0.095 mol) of the acid chloride $B^1Cl$ prepared in Example 4. After stirring 1 h the reaction mixture was poured into 3 L cold water to produce 98 g (after oven drying) crude product. Recrystallization from toluene yielded 84.5 g (0.018 mol) white crystalline dibenzyl ether of the desired coupler. A suspension of 10.4 g (0.01 mol) of this product in 200 mL ethanol and 200 mL tetrahydrofuran was shaken 3 h under 35 psi hydrogen with palladium on charcoal catalyst. Removal of catalyst by filtration, concentration of the filtrate and trituration in hot cyclohexane gave a good yield of coupler Y-2 with the correct elemental analysis.

EXAMPLES 1-14

Photographic elements containing couplers of this invention and control couplers were prepared and tested according to the procedures described below.

All elements were prepared by coating a cellulose acetate butyrate film support with a photosensitive layer containing a silver bromoiodide emulsion at 0.91 g Ag/m$^2$ (when the coupler is 4-equivalent) or 0.46 g Ag/m$^2$ (when the coupler is 2-equivalent)., gelatin at 3.78 g/m$^2$, and one of the couplers identified in Table I dispersed in one-half its weight of the coupler solvent described and coated at $1.62\times10^{-3}$ moles/m$^2$. The photosensitive layer was overcoated with a layer containing gelatin at 1.08 g/m$^2$ and bis-vinyl-sulfonyl-methyl ether at 1.75 weight percent based on total gelatin.

Samples of each element were imagewise exposed through a graduated-density test object and processed at 40° C. employing one of three color developing solutions identified below then stopped, bleached, fixed and washed.

In each element, well-defined, dye images were produced which were evaluated by plotting dye density vs. log exposure sensitometric curves and recording the maximum dye density ($D_{max}$) and gamma ($\gamma$) i.e., the contrast determined by the slope of the straight line portion of the curve. Additionally, dye hues were evaluated from spectrophotometric curves by measuring the maximum absorption peak ($\lambda_{max}$) normalized to a density of 1.0 and the half band width (HBW). Halfband width is the width, in nanometers, of the spectrophotometric curve at one-half the difference between maximum density and stain. Similarly, the top-band width (TBW) and bottom-band width (BBW) of the curve were measured at three-fourths and one-fourth, respectively, of the normalized density. Curve shape factor (CSF) equals 100 X TBW/HBW and provides a ratio of the width near the top and bottom of the absorption curve. The greater this ratio, the steeper are the sides of the absorption peak, and the more efficient is the dye's absorption of light in its spectral region.

All results are recorded in Table I.

These results show that couplers of this invention have enhanced activity, which results in increased maximum dye density and gamma. In addition many of the dyes formed from couplers of this invention have absorption maxima at desirably longer wavelengths and have broader half band widths and larger curve shape factors, resulting in more efficient specral absorption.

TABLE I

| Example No. | Coupler No. (1) | Coupler Solvent (2) | Developer (3) | Activity D-max | Activity $\gamma$ | Hue $\lambda$-max | Hue HBW | Hue CSF |
|---|---|---|---|---|---|---|---|---|
| 1 | M-3 | CS-1 | D-1 | 3.70 | 1.12 | 546 | 96 | 46.0 |
| | CC-1 | CS-1 | D-1 | 3.28 | 1.06 | 531 | 94 | 43.3 |
| 2 | M-8 | CS-2 | D-3 | 4.21 | 2.03 | 550 | 86 | 50.5 |
| | CC-3 | CS-2 | D-3 | 3.68 | 1.30 | 556 | 88 | 45.3 |
| 3 | M-27 | CS-1 | D-1 | 4.40 | 2.14 | 545 | 91 | 47.0 |
| | CC-1 | CS-1 | D-1 | 3.36 | 1.27 | 531 | 94 | 43.6 |
| 4 | M-28 | CS-1 | D-1 | 4.32 | 2.01 | 549 | 92 | 46.7 |
| | CC-1 | CS-1 | D-1 | 3.20 | 1.19 | 531 | 94 | 43.1 |
| 5 | M-28 | CS-2 | D-2 | 4.12 | 1.65 | 541 | 93 | 46.5 |
| | CC-2 | CS-2 | D-2 | 2.96 | 1.04 | 539 | 81 | 46.3 |
| 6 | M-28 | CS-2 | D-3 | 4.98 | 1.88 | 549 | 94 | 46.4 |
| | CC-3 | CS-2 | D-3 | 3.66 | 1.30 | 556 | 88 | 45.3 |
| 7 | M-29 | CS-2 | D-2 | 4.53 | 2.92 | 540 | 88 | 46.7 |
| | CC-2 | CS-2 | D-2 | 2.12 | 0.75 | 539 | 79 | 39.5 |
| 8 | M-29 | CS-2 | D-3 | 4.87 | 3.14 | 545 | 90 | 40.9 |
| | CC-2 | CS-2 | D-3 | 3.03 | 1.05 | 545 | 79 | 40.4 |
| 9 | M-32 | CS-2 | D-2 | 3.15 | 1.32 | 549 | 82 | 40.9 |
| | CC-2 | CS-2 | D-2 | 2.37 | 0.99 | 540 | 78 | 39.9 |
| 10 | C-31 | CS-3 | D-2 | 3.25 | 1.14 | 675 | 160 | 47.0 |
| | CC-4 | CS-3 | D-2 | 2.22 | 0.78 | 659 | 141 | 45.2 |
| 11 | Y-1 | CS-3 | D-2 | 3.39 | 1.44 | 449 | 88 | 43.7 |
| | CC-5 | CS-3 | D-2 | 3.14 | 0.98 | 446 | 88 | 43.5 |
| | CC-6 | CS-3 | D-2 | 1.78 | 0.51 | 441 | 85 | 42.0 |
| 12 | Y-2 | CS-3 | D-2 | 2.82 | 1.13 | 445 | 90 | 44.4 |
| | CC-7 | CS-3 | D-2 | 1.92 | 0.55 | 445 | 85 | 45.2 |
| 13 | Y-3 | CS-3 | D-2 | 1.89 | 0.62 | 441 | 93 | 44.4 |
| | CC-8 | CS-3 | D-2 | 0.57 | 0.14 | 439 | 90 | 44.3 |
| 14 | Y-4 | CS-3 | D-1 | 3.86 | 1.90 | 450 | 90 | 44.6 |
| | CC-9 | CS-3 | D-1 | 3.69 | 1.48 | 450 | 87 | 43.8 |

(1) Comparison Couplers
CC-1
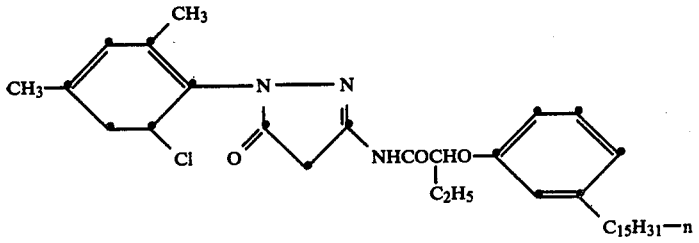
CC-2
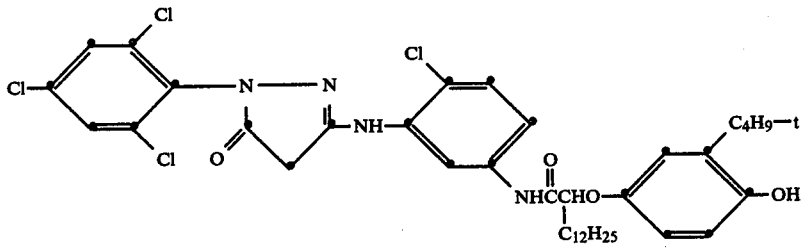
CC-3
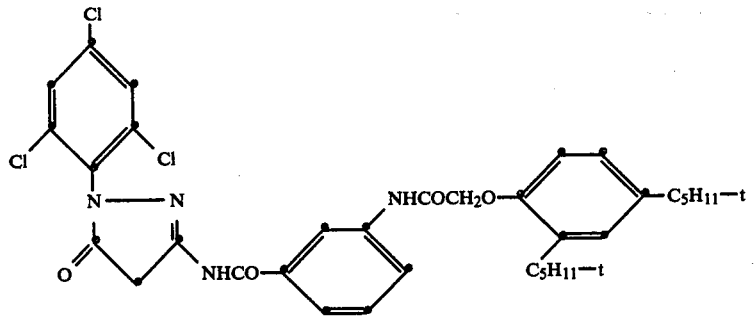
CC-4
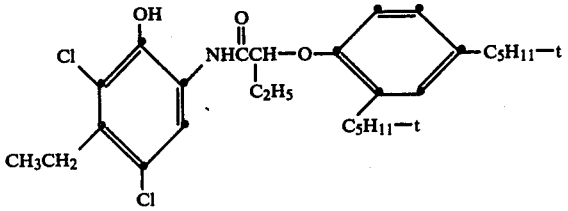
CC-5
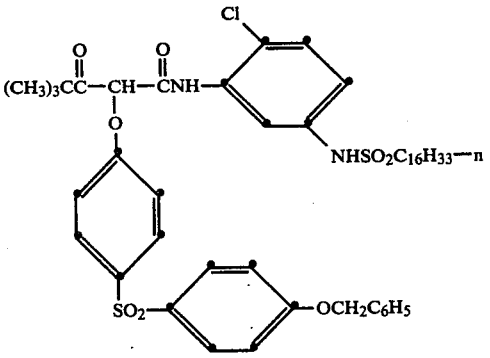

-continued
CC-6
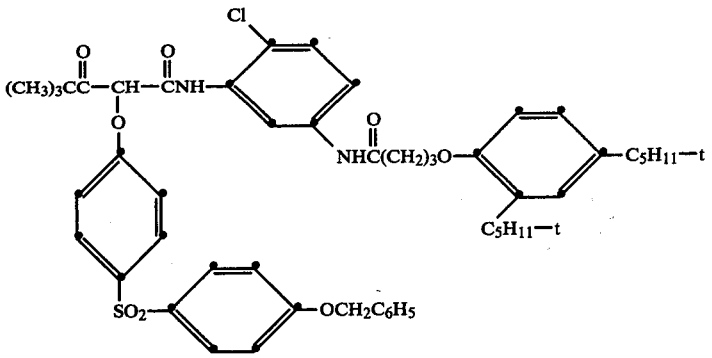
CC-7
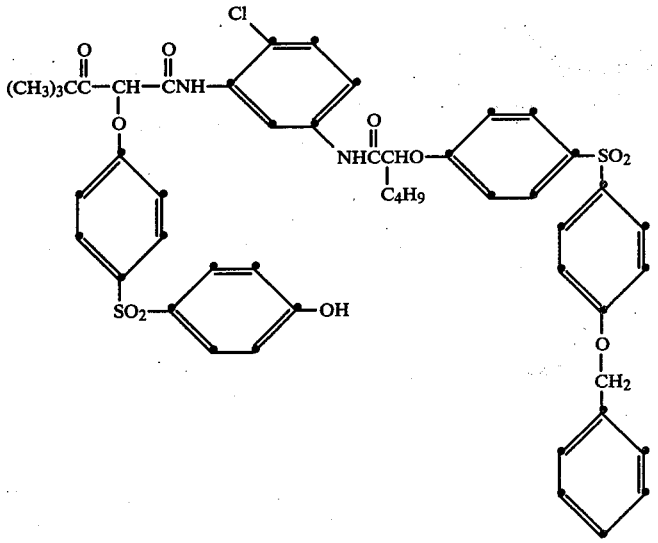
CC-8
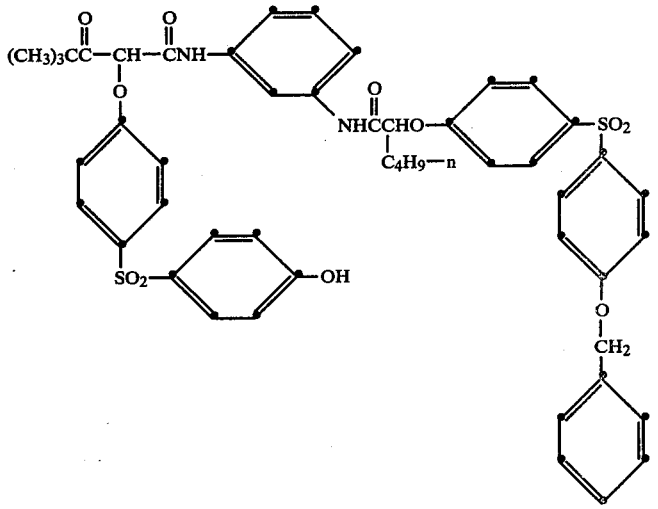

-continued

CC-9

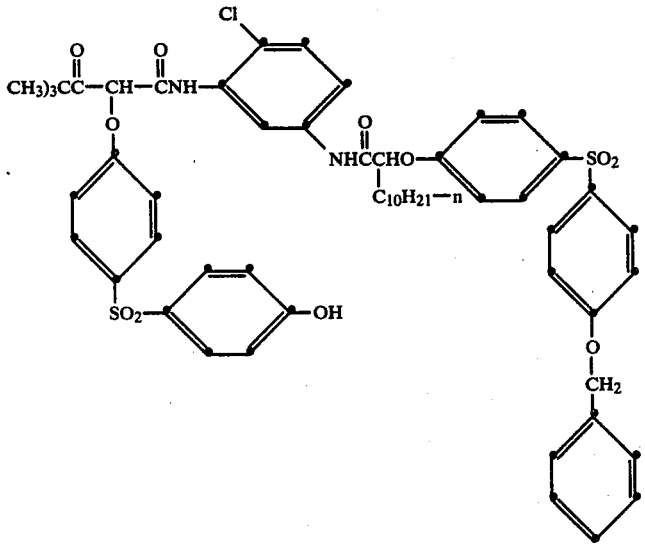

(2) Coupler Solvents

CS-1—1,4-Cyclohexylenedimethylene bis(2-ethylhexanoate)
CS-2—Tri-cresyl phosphate
CS-3—Dibutyl phthalate
CS-4—2,4-Di-t-pentylphenol (3) Developer Formulations

| | D-1 | D-2 | D-3 |
|---|---|---|---|
| 4-Amino-3-methyl-N,N—diethylaniline hydrochloride | 2.45 g | — | — |
| 4-Amino-3-methyl-N—ethyl-N—β-(methanesulfonamido)ethylaniline sulfate | — | 5.0 g | — |
| 4-Amino-3-methyl-N—ethyl-N—β-hydroxyethyl aniline sulfate | — | — | 3.55 g |
| Potassium sulfite | 2.0 g | 2.0 g | 2.0 g |
| Potassium carbonate (anhydrous) | 30.0 g | 30.0 g | 30.0 g |
| Potassium bromide | 1.25 g | 1.25 g | 1.25 g |
| Potassium iodide | 0.6 mg | 0.6 mg | 0.6 mg |
| 1% Solution in methanol of 5-nitro-1H—indazole | 4.0 mL | — | — |
| Water to | 1.0 L | 1.0 L | 1.0 L |
| pH adjusted to | 10.0 | 10.0 | 10.0 |

EXAMPLE 15

Photographic elements containing additional couplers of this invention were prepared, processed and evaluated as described above in connection with Examples 1–14. The results are reported in Table II below.

TABLE II

| Coupler | Coupler Solvent | Dev. | D-max | α | λ-max (nm) | HBW (nm) | CSF % |
|---|---|---|---|---|---|---|---|
| C-2 | CS-3 | D-1 | 3.78 | 1.77 | 655 | 144 | 45.7 |
| C-3 | CS-3 | D-2 | 3.30 | 1.28 | 659 | 161 | 47.8 |
| C-13 | CS-3 | D-3 | 2.99 | 1.11 | 702 | 135 | 44.4 |

TABLE II-continued

| Coupler | Coupler Solvent | Dev. | D-max | α | λ-max (nm) | HBW (nm) | CSF % |
|---|---|---|---|---|---|---|---|
| M-3 | CS-1 | D-1 | 3.70 | 1.12 | 546 | 96 | 45.7 |
| M-9 | CS-4 | D-3 | 4.16 | 1.81 | 558 | 90 | 44.2 |
| M-28 | CS-2 | D-3 | 4.58 | 1.88 | 549 | 94 | 42.6 |

EXAMPLE 16

For each of the couplers identified below, photographic elements were prepared as described above in connection with Examples 1–14. Four samples from each element were exposed as described above. One pair of the exposed elements was developed in developer D-2, described above, and the other pair was developed in this developer to which had been added 1.5 g/L of the soluble competing coupler citrazinic acid. The remaining processing for one element from each pair was stopping, bleaching, fixing and washing while for the second element from each pair the bleaching step was omitted so that the developed silver remained in the element. For those elements in which the silver remained, the amount of developed silver, in g/m$^2$, was determined by x-ray fluorescence analysis and plotted against exposure. For those elements from which the developed silver had been removed, dye density vs exposure curves were generated. From the plots for pairs of elements developed with the same developer composition there was plotted, for each exposure step, dye density vs developed silver. The slope of the line for the elements developed in the absence of a competing coupler ($Y_o$ in Table III, below) is a measure of the efficiency with which the coupler forms dye; the greater the slope the more efficient the coupler. The slope of the line for the elements developed in the presence of the competing coupler ($Y_c$ in Table III, below) is a measure of the reactivity of the coupler, the greater the slope, the more reactive the coupler.

The couplers employed had the following structure:

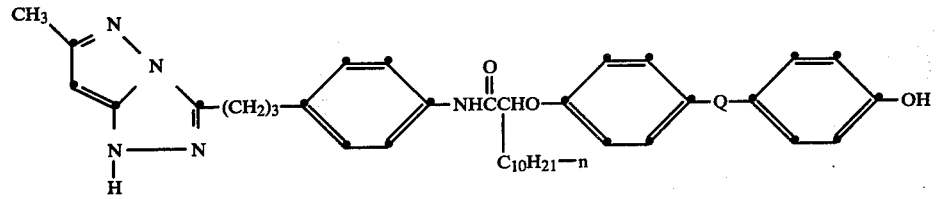

| Coupler | Q |
|---|---|
| M-7 | $-SO_2-$ |
| CC-10 | $-C(CH_3)_2-$ |

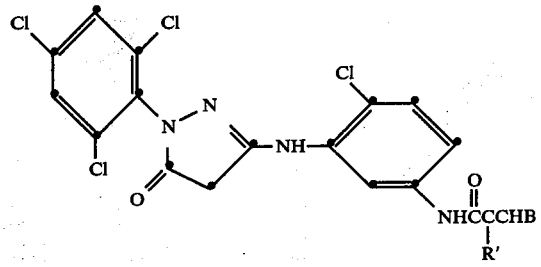

| Coupler | R' | B |
|---|---|---|
| M-19 | $-C_{10}H_{21}-n$ | 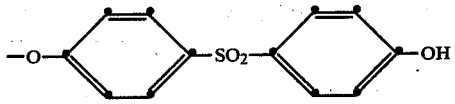 |
| CC-11 | $-C_2H_5$ | 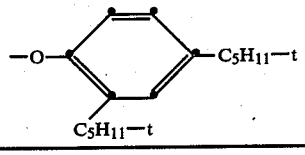 |

TABLE III

| Coupler | Coupler Solvent | $Y_o$ | $Y_c$ | $Y_c/Y_o$ |
|---|---|---|---|---|
| M-8 | CS-4 | 5.55 | 1.73 | 0.312 |
| CC-10 | CS-4 | 1.62 | 0.21 | 0.130 |
| M-28 | CS-2 | 6.30 | 4.65 | 0.738 |
| CC-11 | CS-2 | 4.50 | 1.50 | 0.337 |

It is apparent from the values for $Y_o$ and $Y_c$ in Table III that the couplers of the invention react more efficiently with oxidized developer to form image dye, in the presence or absence of a competing coupler, than do those with ballast groups outside this invention.

This invention has been described in detail with particular reference to certain preferred embodiments thereof, but it will be understood that variations and modification can be effected within the spirit and scope of the invention.

What is claimed is:

1. A photographic element comprising a support, a photographic silver halide emulsion and a photographic coupler comprising a coupler moiety and a ballast moiety, the ballast moiety being terminated with a hydroxyphenylsulfonyl group or a hydroxyphenylsulfinyl group.

2. An element of claim 1 wherein the coupler has the structural formula:

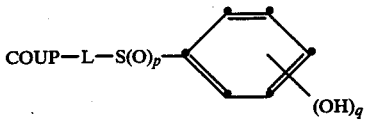

where:

COUP represents a coupler moiety;

p is 1 or 2;

q is 1 to 3; and

L is direct linkage or a bivalent linking group.

3. A photographic element comprising a support, a photographic silver halide emulsion and a photographic coupler wherein the coupler has the structural formula:

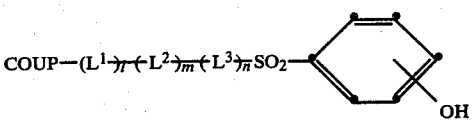

where:

COUP represents a coupler moiety;

l, m and n are each individually 0 or 1;

$L^1$ represents a bivalent group selected from

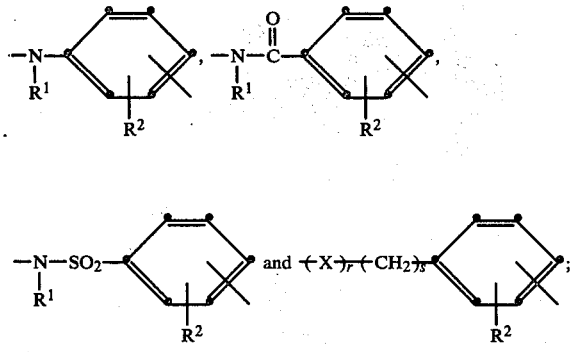

$L^2$ represents a bivalent group selected from

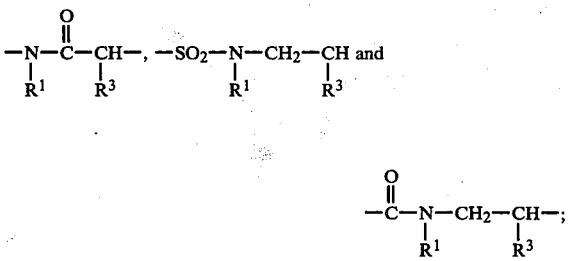

$L^3$ represents a bivalent group selected from

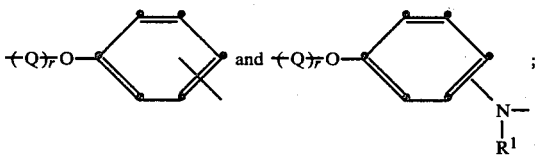

$R^1$ and $R^3$ are each individually hydrogen, alkyl of 1 to 10 carbon atoms or aryl of 6 to 20 carbon atoms;

$R^2$ is hydrogen or one or more halogen, alkyl or alkoxy substituents;

X is —O— or —S—;

Q is $-\overset{O}{\overset{\|}{C}}-$ or $SO_2$;

r is 0 or 1; and s is 0 to 10.

4. An element of claim 3 wherein the coupler has the structural formula:

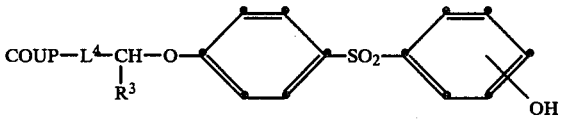

where:

COUP represents a coupler moiety $L^4$ represents a bivalent group selected from

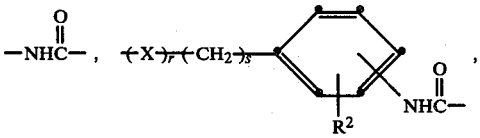

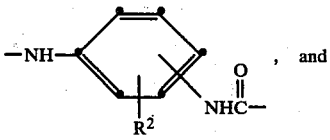

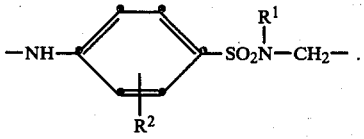

where:

$R^1$ and $R^3$ are each individually hydrogen, alkyl of 1 to 20 carbon atoms or aryl of 6 to 20 carbon atoms;

$R^2$ is hydrogen or one or more halogen, alkyl or alkoxy substituents,

X is —O— or —S—;

r is 0 or 1; and s is 0 to 10.

5. An element of claim 4 wherein the hydroxy group is para to the sulfonyl group.

6. An element of one of claims 2, 3, 4 or 5 wherein the coupler is a yellow dye-forming coupler and COUP is an acylacetanilide coupler moiety.

7. An element of one of claims 2, 3, 4 or 5 wherein the coupler is a cyan dye-forming coupler and COUP is a phenol or naphthol coupler moiety.

8. An element of one of claims 2, 3, 4 or 5 wherein the coupler is a magenta dye-forming coupler and COUP is a pyrazolone, pyrazolotriazole, pyrazolobenzimidazole or indazolone coupler moiety.

9. An element of one of claims 2, 3, 4 or 5 wherein the coupler is a non-dye-forming coupler and COUP is an $\alpha$- or $\gamma$-substituted ketone moiety.

10. An element of claim 3 wherein the coupler has the structure:

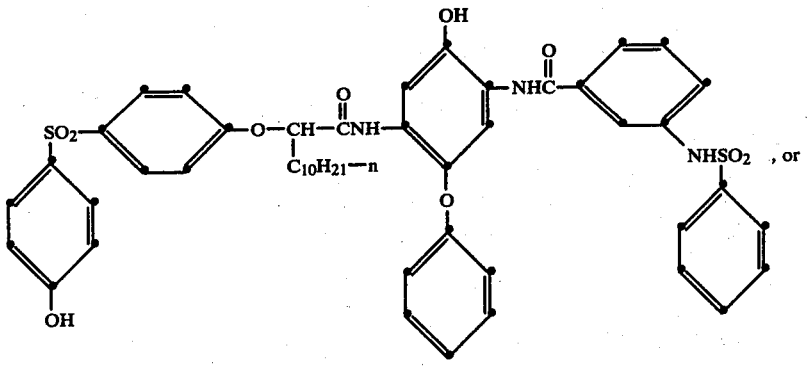
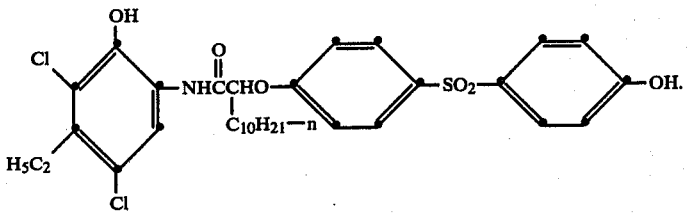
11. An element of claim 3 wherein the coupler has the structure:
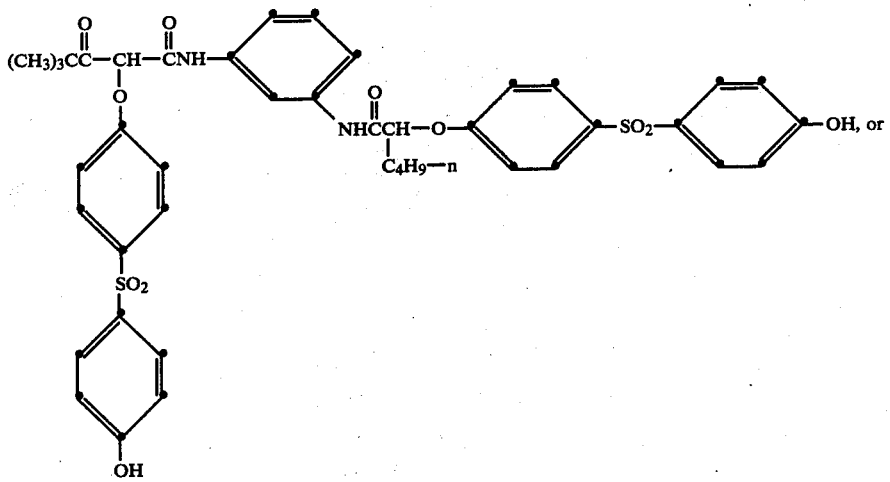
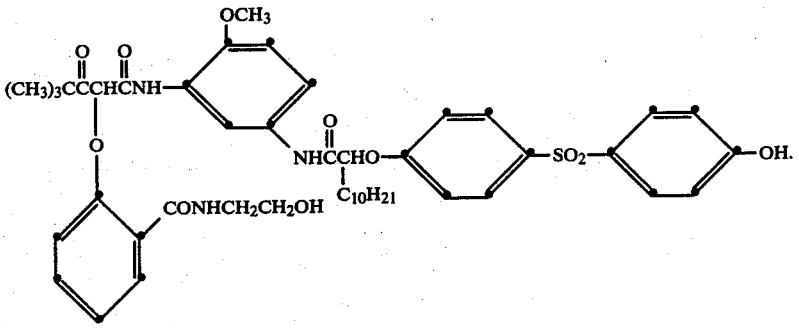
12. An element of claim 3 wherein the coupler has one of the structures:

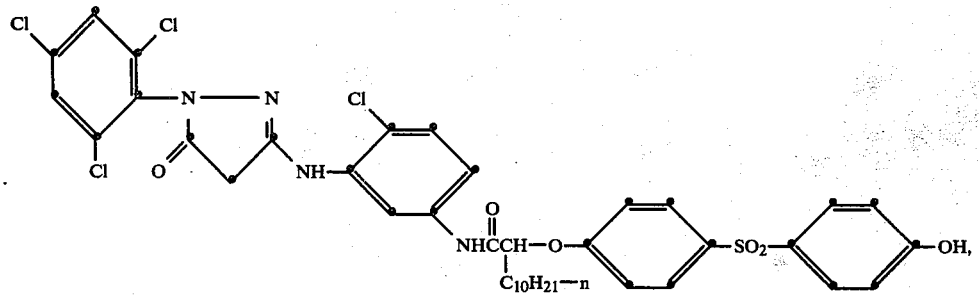
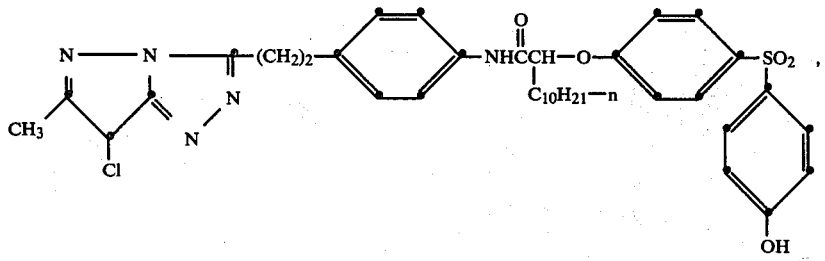
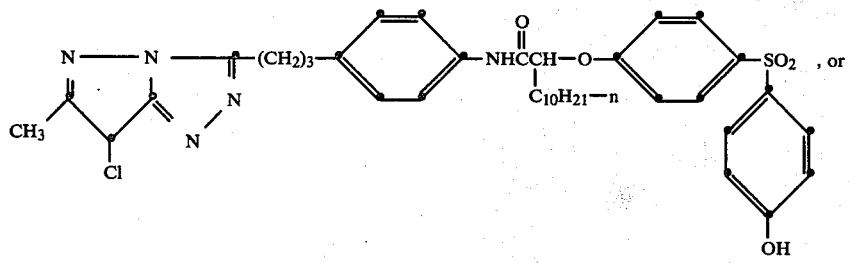
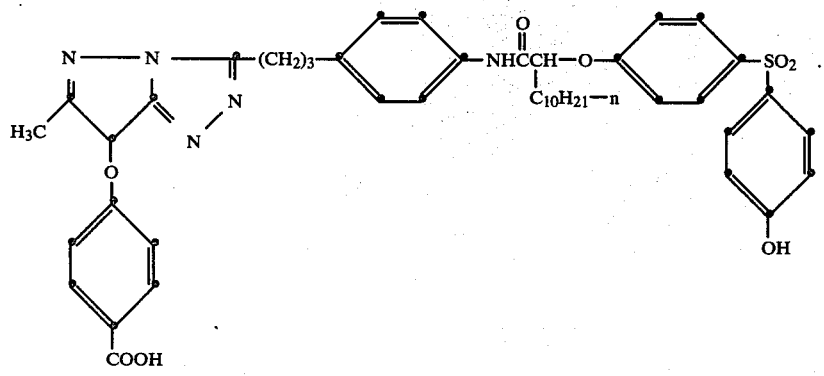
13. An element of claim 3 wherein the coupler has the structural formula:
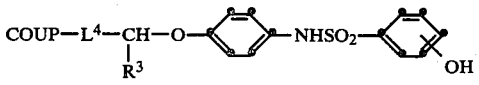
where:
COUP represents a coupler moiety
$L^4$ represents a bivalent group selected from
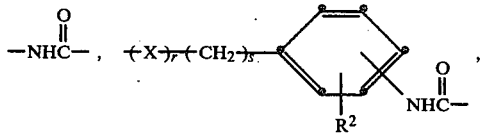
-continued
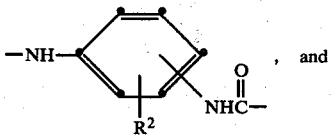
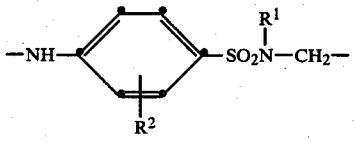
where:
$R^1$ and $R^3$ are each individually hydrogen, alkyl of 1 to 20 carbon atoms or aryl of 6 to 20 carbon atoms;
$R^2$ is hydrogen or one or more halogen, alkyl or alkoxy substituents,
X is —O— or —S—;
r is 0 or 1; and
s is 0 to 10.
* * * * *